US012768191B2

(12) United States Patent
Styrc

(10) Patent No.: US 12,768,191 B2
(45) Date of Patent: Oct. 20, 2026

(54) MODULAR FENCE SYSTEM

(71) Applicant: 2724889 ONTARIO INC., Oakville (CA)

(72) Inventor: Jacek Styrc, Oakville (CA)

(73) Assignee: 2724889 ONTARIO INC., Oakville (CA)

( * ) Notice: Subject to any disclaimer, the term of this patent is extended or adjusted under 35 U.S.C. 154(b) by 218 days.

(21) Appl. No.: 18/601,639

(22) Filed: Mar. 11, 2024

(65) Prior Publication Data

US 2024/0309674 A1 Sep. 19, 2024

Related U.S. Application Data

(60) Provisional application No. 63/490,371, filed on Mar. 15, 2023.

(51) Int. Cl.
*E04H 17/22* (2006.01)
*E04H 17/00* (2006.01)
*E04H 17/14* (2006.01)

(52) U.S. Cl.
CPC ..... *E04H 17/22* (2013.01); *E04H 17/1452* (2021.01); *E04H 17/006* (2021.01)

(58) Field of Classification Search
CPC ..... E04H 17/009; E04H 17/1447; E04H 17/1452; E04H 17/1456; E04H 17/1488; E04H 17/16; E04H 17/165; E04H 17/168; E04H 17/17; E04H 17/20; E04H 17/22; E04H 17/23; E04H 12/22; E04H 12/2253; E04H 12/2261; E04H 12/2269; E04F 2011/1831
See application file for complete search history.

(56) References Cited

U.S. PATENT DOCUMENTS

| | | | | |
|---|---|---|---|---|
| 396,624 | A | 1/1889 | Thomas | |
| 4,381,160 | A | 4/1983 | Grimm et al. | |
| 4,429,497 | A | 2/1984 | Dibernardi | |
| D277,643 | S * | 2/1985 | Fambrough | D8/373 |
| 5,568,909 | A | 10/1996 | Timko | |
| 6,336,620 | B1 | 1/2002 | Belli | |

(Continued)

FOREIGN PATENT DOCUMENTS

| | | | |
|---|---|---|---|
| CA | 2075574 A1 * | 2/1994 | |
| FR | 3066211 A3 * | 11/2018 | E04H 17/168 |

(Continued)

OTHER PUBLICATIONS

Notice of Allowance for U.S. Appl. No. 29/986,944, USPTO, dated: Jul. 17, 2025.

(Continued)

*Primary Examiner* — Jonathan P Masinick
(74) *Attorney, Agent, or Firm* — Chris Dynowski; Bhole IP Law

(57) ABSTRACT

A fence post bracket having a first wall portion, a pair of second wall portions extending perpendicular to the first wall portion, and a base orthogonal to the wall portions and secured thereto. The base extends between the second wall portions and beyond each of the wall portions to provide a flange and apertures in the flange to receive fastenings. The wall portions receive the post and the post is elevated by the base.

15 Claims, 10 Drawing Sheets

(56) References Cited

U.S. PATENT DOCUMENTS

| | | | | |
|---|---|---|---|---|
| 6,786,017 | B2 * | 9/2004 | Thompson | E04B 2/7433 52/298 |
| D547,463 | S | 7/2007 | Gross et al. | |
| D610,717 | S | 2/2010 | Lin | |
| D610,718 | S | 2/2010 | Ringus et al. | |
| D630,935 | S | 1/2011 | Jarvis | |
| D643,546 | S | 8/2011 | Ringus et al. | |
| D697,391 | S | 1/2014 | Le | |
| 8,757,598 | B1 | 6/2014 | Jones | |
| 9,476,218 | B2 * | 10/2016 | Takahashi | E02D 27/42 |
| D777,015 | S | 1/2017 | Deveci | |
| 10,161,161 | B2 * | 12/2018 | Yin | E04H 17/1408 |
| D839,081 | S | 1/2019 | Iellimo | |
| 10,378,232 | B2 * | 8/2019 | Volin | E04H 12/2261 |
| D884,928 | S | 5/2020 | Gordon | |
| 10,951,158 | B2 * | 3/2021 | Chang | F24S 25/60 |
| D936,860 | S | 11/2021 | Styrc et al. | |
| D952,384 | S | 5/2022 | Styrc | |
| D966,076 | S | 10/2022 | Charette | |
| 11,891,826 | B2 | 2/2024 | Milanowski et al. | |
| D1,024,357 | S | 4/2024 | Newman | |
| 12,123,212 | B2 * | 10/2024 | Paananen | E04H 12/2269 |
| 2004/0245516 | A1 | 12/2004 | Fuoco | |
| 2006/0186391 | A1 * | 8/2006 | Hansen | E06B 3/5454 256/24 |
| 2007/0235616 | A1 | 10/2007 | Gross et al. | |
| 2013/0061453 | A1 | 3/2013 | Rosendahl | |
| 2015/0211235 | A1 | 7/2015 | Sneith et al. | |
| 2017/0058557 | A1 * | 3/2017 | Wu | E04H 17/22 |
| 2018/0230664 | A1 | 8/2018 | Dominguez | |
| 2018/0238041 | A1 * | 8/2018 | Styrc | E04F 10/08 |
| 2022/0090385 | A1 | 3/2022 | Leary | |
| 2023/0003031 | A1 | 1/2023 | Leary | |
| 2023/0212875 | A1 * | 7/2023 | Walker | E04H 17/168 256/24 |
| 2024/0093529 | A1 | 3/2024 | Gutierrez | |
| 2024/0200319 | A1 | 6/2024 | Styrc | |
| 2025/0333974 | A1 * | 10/2025 | Goldstein | E04H 12/2269 |

FOREIGN PATENT DOCUMENTS

| | | | | |
|---|---|---|---|---|
| GB | 2259924 A | * | 3/1993 | E04H 17/20 |
| GB | 2580097 A | | 7/2020 | |
| GB | 6310536 | | 9/2023 | |
| GB | 6310537 | | 9/2023 | |
| KR | 101047370 B1 | * | 7/2011 | |

OTHER PUBLICATIONS

Notice of Allowance for U.S. Appl. No. 29/986,947, USPTO, dated: Jul. 18, 2025.

"Support Foot Post Post Shoe open galvanised", 4U-Onlinehandel, posted Nov. 29, 2016 [online], [retrieved Jun. 27, 2025]. Retrieved from internet, (Year: 2016).

"Vanroug 4Pcs Adjustable Wood Fence Pergola Post Base Brackets Kit", amazon posted Feb. 21, 2023 [online], [retrieved Jun. 27, 2025]. Retrieved from internet, (Year: 2023).

Office Action for U.S. Appl. No. 29/872,601, USPTO, dated: Aug. 27, 2024.

Partial European Search Report for application No. 24163406.2, EPO, search completed: Jul. 10, 2024, communication dated: Jul. 22, 2024.

* cited by examiner

MODULAR FENCE SYSTEM

FIELD OF THE INVENTION

The present invention relates to fence components used to assemble fences.

DESCRIPTION OF THE PRIOR ART

Fences are used to segregate different areas of a landscape for visual, privacy or safety reasons. Fences may take many different forms depending on their intended use but typically consist of vertical posts spaced apart along the intended line of segregation with panels or panels supported between a pair of posts. The panels can be made off suitable materials such as wood, glass or metal to meet the intended purpose and secured to the posts by fasteners.

Where the fence extends along the ground, the posts are usually located in a hole and secured by concrete. Where the fence is used around a platform, such as a deck or balcony, the posts need to be secured to the substructure of the platform to withstand the horizontal loads that may be imposed on them.

The posts are usually made from dimensional lumber, a nominal 4×4 or 6×6 and are secured to the platform by a deck post bracket. These are a metal socket with a peripheral flange so the post may be inserted in the socket and the flange fastened to the platform.

The sockets are dimensioned to receive the nominal sizes of the dimensional lumber which can be secured with fasteners through the socket walls. Whilst the lumber is nominally all the same dimensions, in practice it may vary from piece to piece, sometimes by as much as ¼". This means the post is a loose fit in the socket even with the fastenings in place and does not provide the stability required. Alternatively the post may be oversize so that it cannot be inserted in the socket without material being removed from the post.

Attempts have been made to address this by providing a gap in the socket which can be closed by bolts to proved a snug fit for the post. Such arrangements can weaken the socket to flange connection and have a utilitarian appearance that makes them unsuitable for aesthetically pleasing construction.

The provision of a socket may also complicate the attachment of a panel to the post. In many jurisdictions there is a maximum gap between a platform and the lower edge of a panel, typically 4 inches (100 mm) and for ease of installation the socket does not extend above this limit. Consequently the maximum depth of the socket and thereby the overlap between the post and socket is also limited. The socket may also prevent the panel from being located closer to the platform when required.

A further problem with the existing sockets is that they trap moisture around the base of the post and make the post vulnerable to rot.

It is therefore an object of the present invention to obviate or mitigate the above disadvantages.

SUMMARY OF THE INVENTION

According to one aspect of the present invention there is provided a fence post bracket having a first wall portion, a pair of second wall portions extending perpendicular to the first wall portion, and a base orthogonal to the wall portions and secured thereto, said base extending between said second wall portions and beyond each of said wall portions to provide a flange and apertures in the flange to receive fastenings, whereby said wall portions receive said post and said post is elevated by said base

BRIEF DESCRIPTION OF THE DRAWINGS

The features of the invention will become more apparent in the following detailed description in which reference is made to the appended drawings wherein.

DETAILED DESCRIPTION OF THE INVENTION

Figure 1:
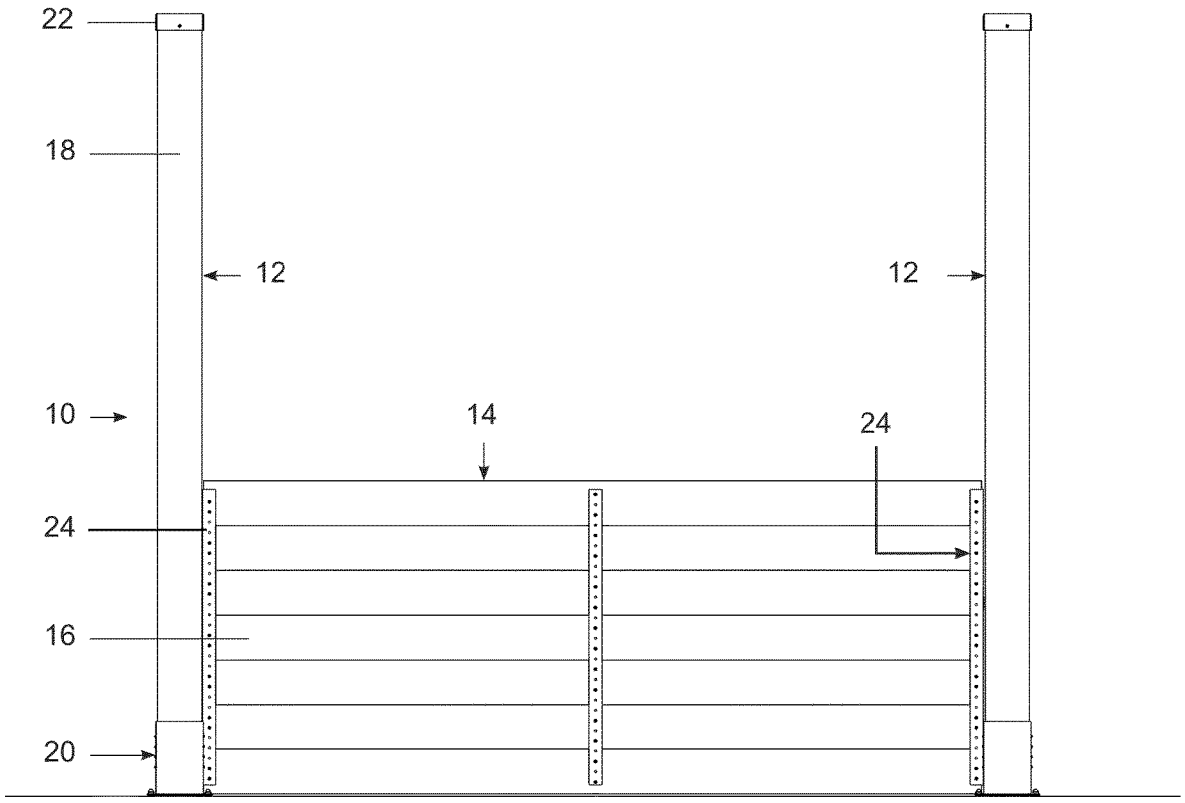
FIG. 1 is an elevation of a fence.

Referring first to FIG. 1, a fence indicated at 10 includes a pair of post assemblies 12 are laterally spaced with a panel 14 extending between them. The panel 14 comprises a number of horizontal boards 16 stacked on edge to the required height. Typically these are dimensional lumber such as a 1×4 or 1×6. Alternative forms of panel may be used including sheet material, glass, metal.

The post assemblies include a post 18 made from dimensional lumber, such as a 4×4 or 6×6, that is supported in a post socket 20. The post 18 has outwardly directed planar faces 19 and is usually square in cross section. A cap 22 is located on the upper end of the post 18. The post 18 is cut to the desired height and may be flush with the top of the boards 16 or extend above as shown in FIG. 1 to support an adjacent higher panel.

Figure 2:
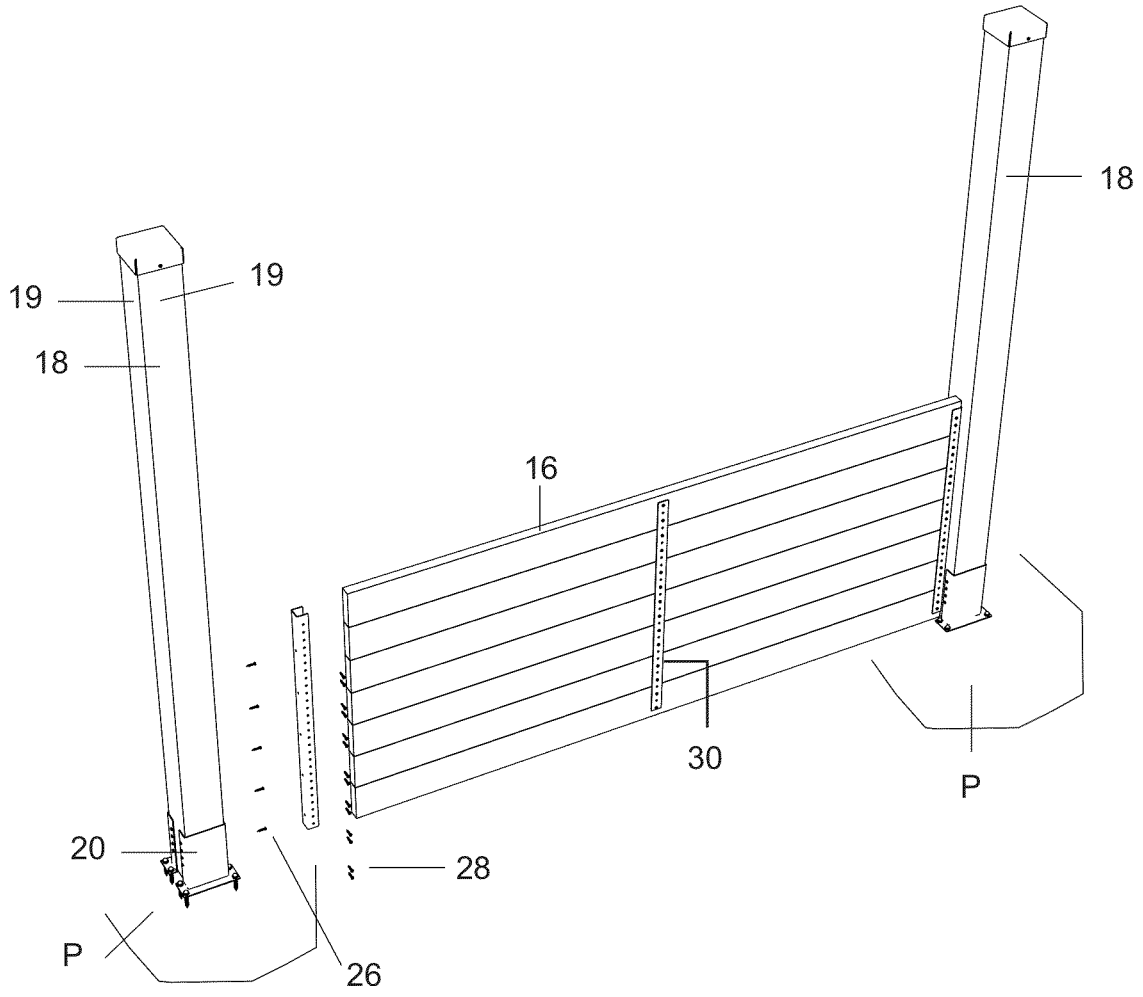
FIG. 2 is an exploded perspective view of the fence of FIG. 1

The panel 14 is secured to one face of the post 18 by a structural member exemplified as a channel member 24 shown in FIG. 2. The channel member 24 is aligned on the longitudinal axis of the post and secured by screws 26 that pass through predrilled holes in the base of the channel 24, The boards 16 may then be slid into the channel member 24 and secured with screws 28 passing through pre-drilled holes in the sides of the channel member 24. It will be appreciated that other structural members could be used, such as an angle piece.

A vertical strap 30 may be attached to the centre of the panel 14 to join the boards to one another midspan and stabilise the panel if necessary.

Figure 3:
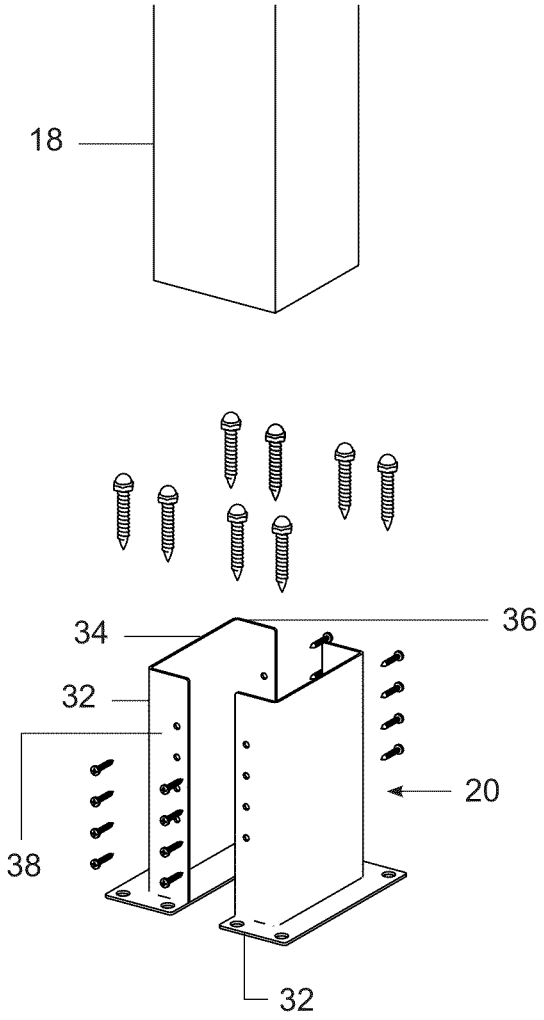
FIG. 3 is an exploded perspective view of the post bracket used in the fence of FIG. 1
Figure 4:
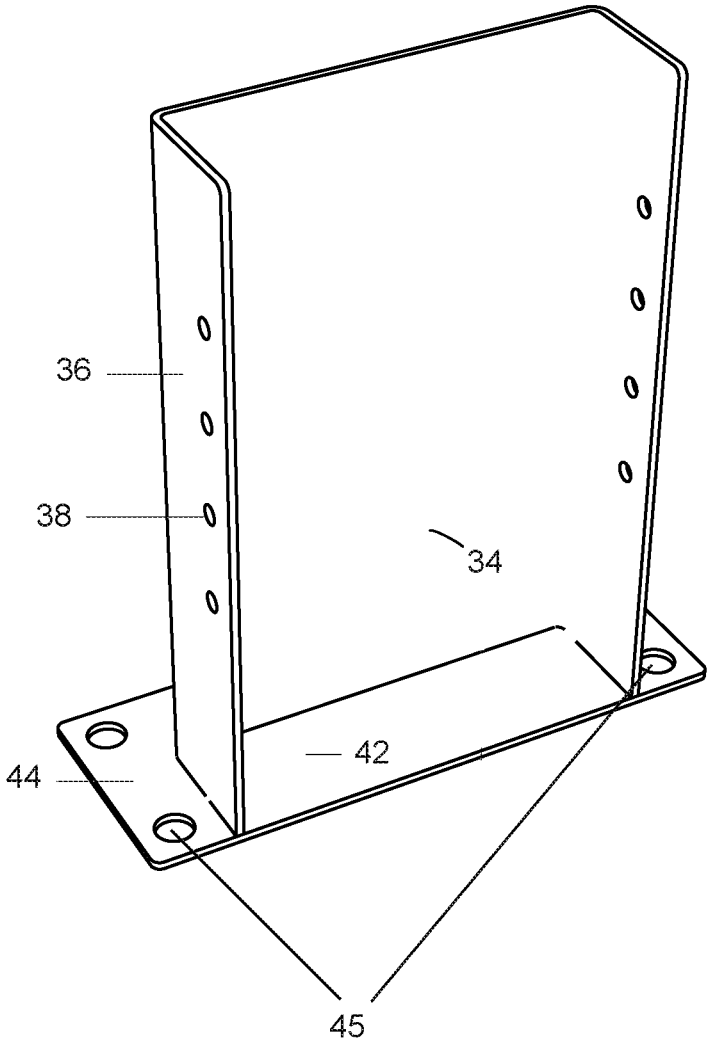
FIG. 4 is an enlarged perspective view of one of the components used in the bracket of FIG. 3
Figure 5:
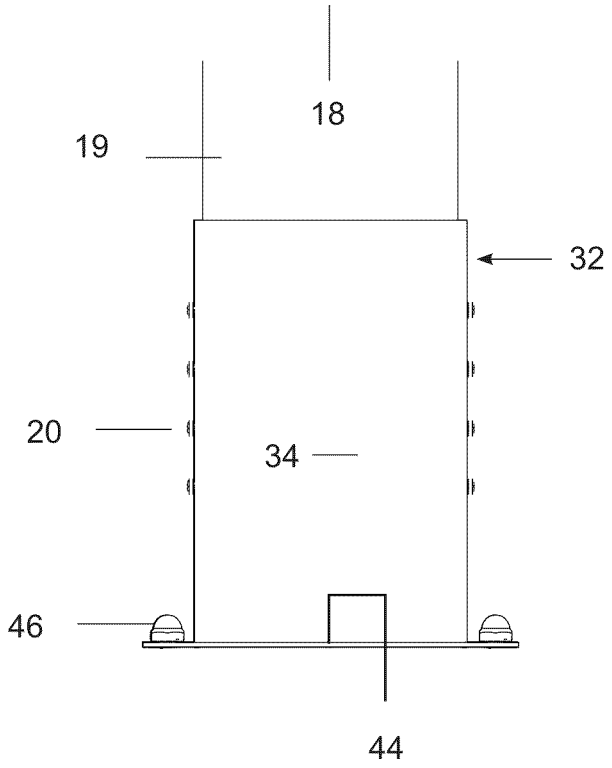
FIG. 5 is a perspective view of the assembled fence of FIG. 1
Figure 6:
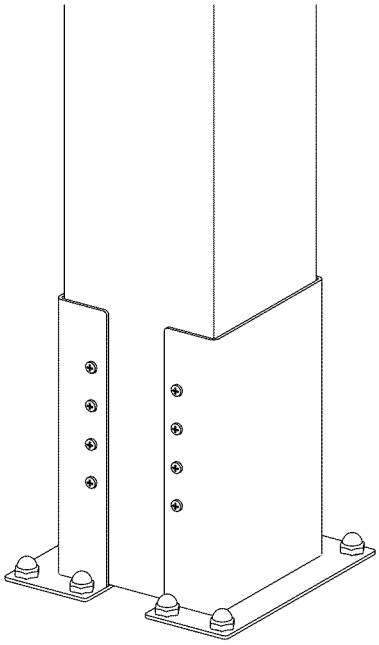
FIG. 6 is a side view of FIG. 5

Referring to FIGS. 3 and 4, the post socket 20 comprises a pair of brackets formed as shoes 32. Each of the shoes 32 has a central wall portion 34 that is subtended at each end by end wall portions 36. The end wall portions 36 are disposed at 90° to the central wall portion 34.

The spacing between the end wall portions 36 corresponds to the nominal dimension of the intended post, 3.5 inches for a 4×4 or 5.5 inches for a 6×6. The central wall portion 34 and end wall portions 36 may be formed from a common steel blank folded at the junction of the end wall portion 36 with the central wall portion 34, or as a weldment in which the wall portions 34, 36 are connected by welding, or molded from a resilient plastics material such as nylon. A row of holes 38 are punched in each of the end wall portions 36 to receive screws 40.

The shoe 32 further comprises a base 42 which is secured to one edge of the wall portions 34, 36 by welding or the like The base 42 extends between the end wall portions 36 and projects beyond each of the wall portions 34, 36 to provide a flange 44 with holes 45 to receive fasteners 46 that secure the base 42 to a platform or substructure.

To secure a post 18 to the socket 20, a first shoe 32 is placed on one face 19 of the post 18 so the face is against the central wall portion 34 and the side wall portions 36 extend over adjacent faces 19 of the post 18. The base 42 is positioned against the end face of the post 18 so the post will rest on the base 42 when installed and the shoe 32 secured by screws 40.

Another shoe 32, identical to the first shoe, is secured in a similar manner to the opposite face of the post 18 and the flanges 44 may then be connected to the platform. With the flanges 44 secured to the platform, the end of the post 18 is elevated above the platform by the thickness of the base 42 providing a spacing between the central portion of the post and the platform. This facilitates drainage of water from the end of the post to preserve its integrity.

It will be noted that the edges of the end wall portions 34 are separated from one another when assembled on the post 18 which allows the shoes 32 to adjust to varying dimensions of the post 18, ensuring a snug fit on the post. The gap between the end wall portions 36 also allows the channel member 24 to be accommodated so it can extend fully to the platform if so required. Similarly, the wall portions 34, 36 may extend along the post 18 beyond the maximum permitted height of the lower edge of the panel 14 from the platform with the channel extending between the shoes 32.

The screws 40 are located on the end wall portions, leaving the central wall portion imperforate to provide an aesthetically pleasing assembly.

Figure 7:
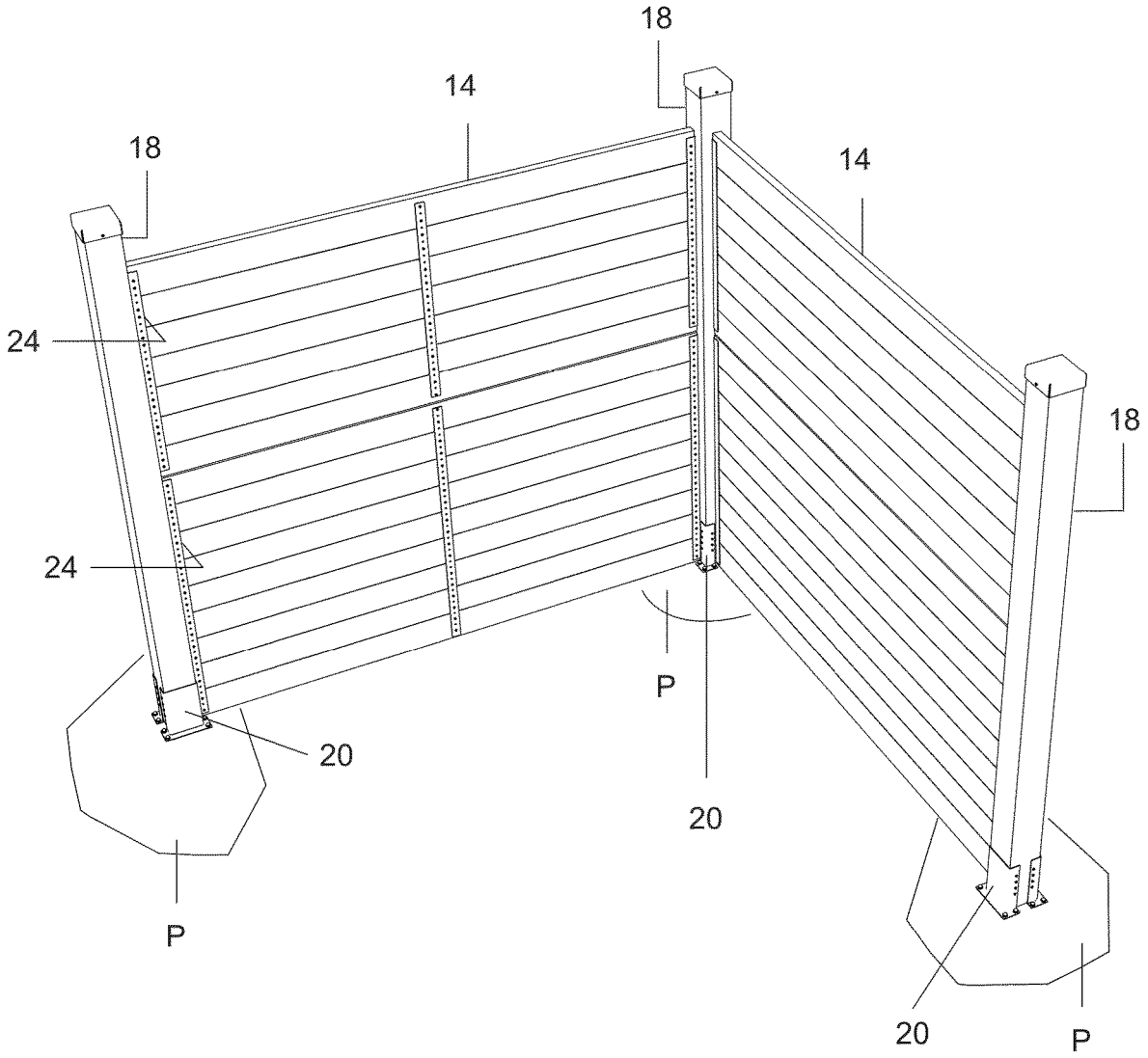
FIG. 7 is a perspective view of an alternative arrangement of fence.
Figure 8:
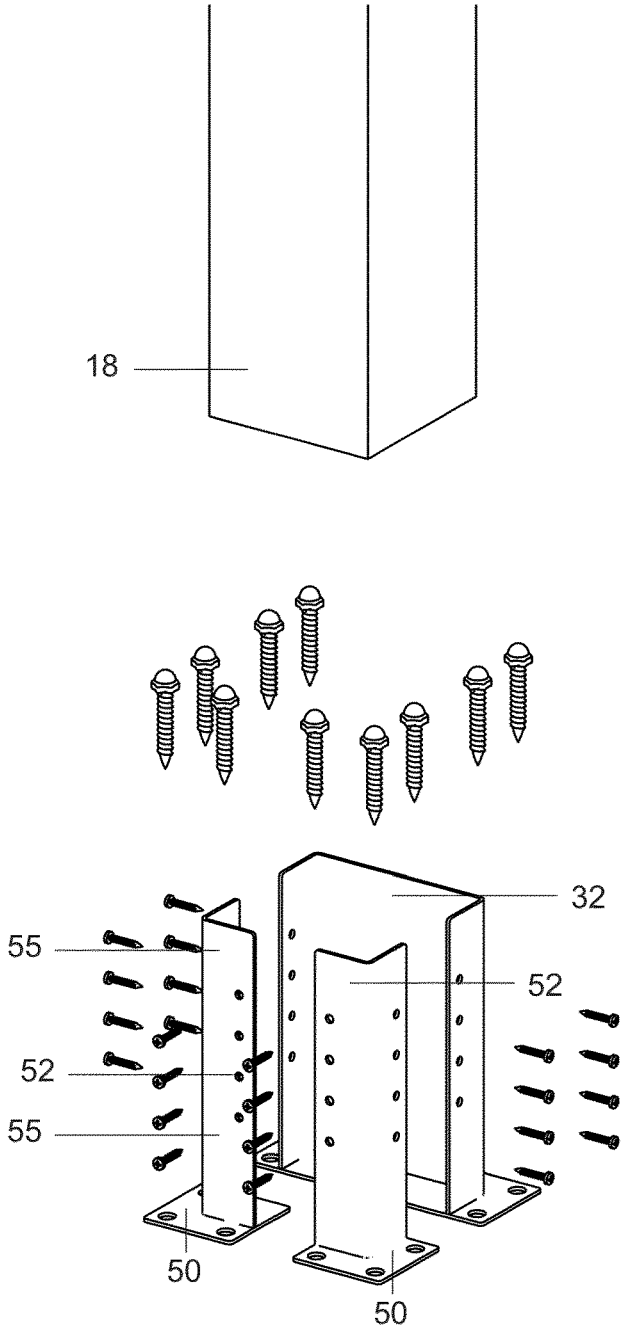
FIG. 8 is an exploded perspective view of a bracket arrangement for the fence of FIG. 7
Figure 9:
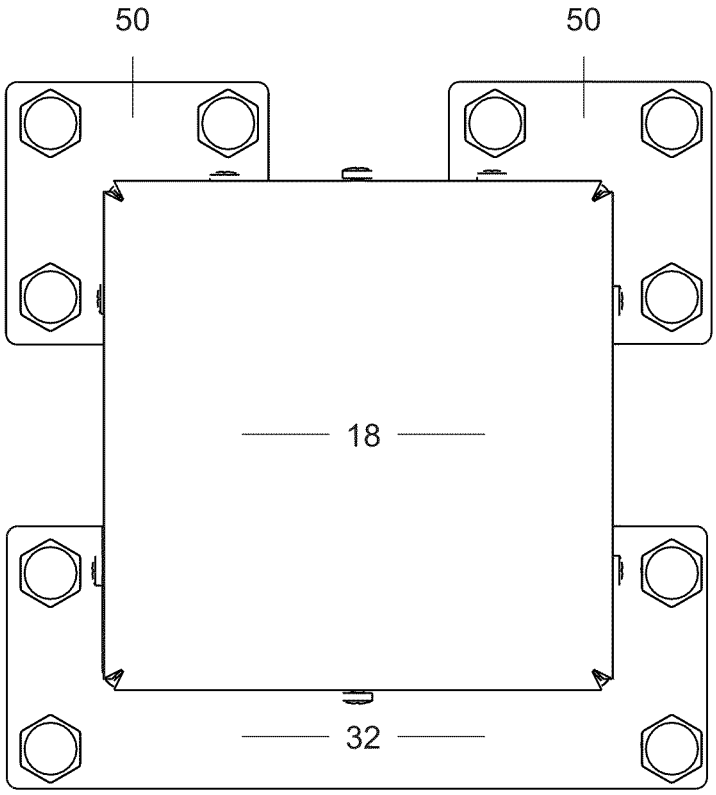
FIG. 9 is a plan view of the fence of FIG. 7.

The fence of FIG. 1 is shown with a linear arrangement but as shown in FIG. 7, a similar arrangement can be used to provide a corner where two panels 14 extend perpendicular to one another. The arrangement of posts, boards and channels is similar to that shown in FIG. 1 but a modification is made to the post socket 20 as shown in FIG. 8.

A shoe 32 as described above is used on the external corner of the post 18. However, to accommodate a channel member 24 on the adjacent faces of the post 18 an alternative arrangement to the shoe 32 is used. A pair of corner brackets 50 are used on the other two corners to support the post 18. Each of the corner brackets 50 is formed from an angle piece 52 which is welded to a base 54. The angle piece 52 provides a pair of wall portions 55 disposed perpendicular to one another. The base 54 projects laterally beyond the angle piece 52 and so bridges the interior of the angle piece 52 and provides a flange 56 for securing the bracket 50 to the platform. Screw holes 58 are provided on each wall portion 55 of the angle piece 52 to allow it to be secured to the post 18.

The shoe 32 and corner brackets 50 are connected at one end of the post so that the end wall portions 36 and the wall portions 55 extend partially across respective faces 19 of the post 18. The flanges 44, 56 are secured to the platform and the bases 42, 54 support the post 18 with a clearance for drainage. The spacing between the corner brackets 50 allows for a channel member 24 to be positioned between the wall portions and so extend along the whole length of the post 18 if required.

Figure 10:
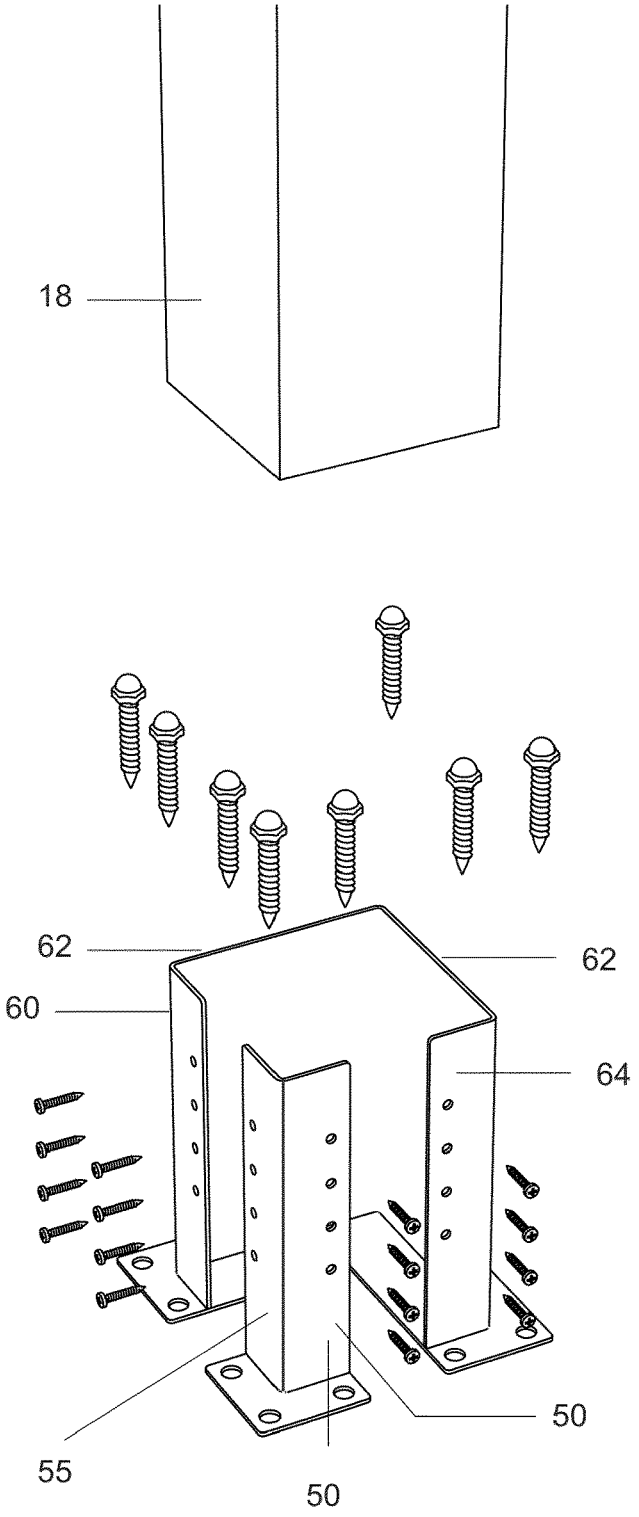
FIG. 10 is an view similar to FIG. 8 of an alternative embodiment of bracket.

A similar arrangement is shown in FIG. 10 where a shoe 60 has two major wall portions disposed at right angle with a minor end wall portion projecting from each edge of the major wall portions. A corner bracket 50 is used to secure the remaining corner of the post. With this arrangement provision is made for a pair of channels 24 on adjacent faces but the external major faces are imperforate to enhance the aesthetics.

It will be noted in FIG. 7 that the post 18 supports a higher panel 14. This conveniently is provided by two panels 14 as shown in FIG. 1 stacked one above another. Each panel 14 has a channel 24 secured to the post 18 so that the channels are aligned. In this way the number of components required to enable different height fences to be constructed is reduced allowing a modular construction with different heights in combination if required. The stacked panels may of course be used in a linear array rather than at a corner.

Although the invention has been described with reference to certain specific embodiments, various modifications thereof will be apparent to those skilled in the art without departing from the spirit and scope of the invention as outlined in the claims appended hereto. The entire disclosures of all references recited above are incorporated herein by reference.

What is claimed is:

1. A fence post bracket having at least one first wall portion, a pair of second wall portions extending perpendicular to a respective one of said at least one first wall portion and terminating in spaced relation to each other, and a base orthogonal to the wall portions and secured thereto, said base extending between said second wall portions and beyond each of said wall portions to provide a flange and apertures in the flange to receive fastenings for securing to an underlying support surface, whereby said wall portions receive said post therebetween and said post is elevated by said base from said underlying support surface and wherein vertically spaced apart apertures are provided in each of said second wall portions to receive fasteners for securing to the post.

2. The fence post bracket of claim 1 wherein each of said at least one first wall portions is imperforate.

3. The fence post bracket of claim 1 or 2 wherein there is only one first wall portion and said second wall portions extend perpendicular thereto along opposite edges of said first wall portion.

4. A fence post bracket of claim 1 or 2 having a pair of first wall portions connected along a common edge, and said pair of second wall portions extend perpendicular to the respective ones of said first wall portions and spaced from said common edge.

5. A fence post socket assembly to secure a square post in a vertical orientation, said socket assembly comprising:

a first bracket having at least one first wall portion, each of which overlies a respective outer face of said post, a pair of second wall portions extending perpendicular to a respective one of said at least one first wall portions to extend partially across faces adjacent to an outer face of said post, and a base orthogonal to the wall portions and secured thereto, said base extending between said second wall portions and beyond each of said wall portions to provide a flange and apertures in the flange to receive fastenings for securing to an underlying support surface;

a second bracket distinct from the first bracket, the second fence post bracket having a pair of interconnected wall portions in opposite and spaced relation to the second wall portions of the first bracket, and a base of the second bracket extending between and beyond said interconnected wall portions to provide a flange of the second bracket spaced from the flange of the first bracket and apertures in said flange of the second bracket to receive fastenings for securing to an underlying support surface;

whereby said wall portions receive said post therebetween and said post is elevated by said bases from said underlying support surface.

6. The fence post socket assembly of claim 5 wherein the interconnected wall portions of said second bracket are disposed perpendicular to one another, such that said second bracket is overlying a corner of said post.

7. The fence post socket of claim 5 or 6 wherein said first bracket has only one first wall portion and said second wall portions extend perpendicular thereto along opposite edges of said first wall portion.

8. The fence post socket of claim 7 when dependent on claim 6, further including a third bracket having a pair of wall portions disposed perpendicular to one another and a base extending between and beyond said wall portions to provide a flange and apertures in said flange to receive fasteners, said third bracket overlying a further corner of said post.

9. A fence comprising a post, a panel secured to said post and a socket assembly to support said post in a vertical orientation, said socket assembly having a pair of brackets each with wall portions extending partially across a face of said post, said wall portions of said brackets being spaced from one another on said face to provide a gap between said brackets and said panel passing through said gap.

10. The fence according to claim 9 wherein said panel is secured to said post by a structural member passing through said gap.

11. The fence according to claim 10 wherein the structural member is a channel having a base secured to said post and receiving said panel within the channel.

12. The fence according to any one of claims 9 to 11 wherein a first one of said pair of brackets has at least one first wall portion, a pair of second wall portions extending perpendicular to a respective one of first wall portion, and a base orthogonal to the wall portions and secured thereto, said base extending between said second wall portions and beyond each of said wall portions to provide a flange and apertures in the flange to receive fastenings, and a second one of said pair of brackets has a pair of third wall portions disposed perpendicular to one another with a base extending between and beyond said third wall portions, respective ones of said second and third wall portions extending partially across a common face of said post being spaced from one another to provide said gap, whereby said wall portions receive said post and said post is elevated by said base.

13. The fence according to claim 12 wherein the first and second brackets of said pair of brackets are identical.

14. The fence according to any one of claims 9 to 11 wherein the second bracket extends about a corner of said post.

15. The fence according to claim 12 wherein the second bracket extends about a corner of said post.

* * * * *